US006447286B1

(12) United States Patent
Snuggs

(10) Patent No.: US 6,447,286 B1
(45) Date of Patent: Sep. 10, 2002

(54) CANDLE EXTINGUISHING APPARATUS

(76) Inventor: Stuart E. Snuggs, 2125 Wayside Ct., Fort Worth, TX (US) 76115

( * ) Notice: Subject to any disclaimer, the term of this patent is extended or adjusted under 35 U.S.C. 154(b) by 0 days.

(21) Appl. No.: 09/723,883

(22) Filed: Nov. 28, 2000

(51) Int. Cl.[7] ..... F23Q 25/00; F23N 5/00

(52) U.S. Cl. ..... 431/35; 431/293; 431/289; 431/149; 431/151

(58) Field of Search ..... 431/35, 34, 33, 431/293, 292, 289, 144, 149, 146, 151; 362/447, 161; 169/46, 54

(56) References Cited

U.S. PATENT DOCUMENTS

| | | | | | |
|---|---|---|---|---|---|
| 510,907 | A | * | 12/1893 | French | 431/293 |
| 660,899 | A | * | 10/1900 | Hagen | 431/35 |
| 767,892 | A | * | 8/1904 | Isakson | 431/35 |
| 897,712 | A | * | 9/1908 | Brusseau | 431/33 |
| 945,963 | A | * | 1/1910 | Lang | 362/447 |
| 964,841 | A | * | 7/1910 | Bernau | 431/293 |
| 1,308,215 | A | * | 7/1919 | Baird | 431/35 |
| 1,597,991 | A | * | 8/1926 | Markert | 431/293 |
| 4,496,307 | A | * | 1/1985 | Ginardi | 431/34 |
| 5,879,152 | A | * | 3/1999 | Griffel | 431/293 |
| 5,944,505 | A | | 8/1999 | Kroecher | |

FOREIGN PATENT DOCUMENTS

| | | | | |
|---|---|---|---|---|
| JP | 10-162643 A | * | 6/1998 | 431/35 |

* cited by examiner

*Primary Examiner*—Henry Bennett
*Assistant Examiner*—Josiah C. Cocks
(74) *Attorney, Agent, or Firm*—Arthur F Zobal

(57) ABSTRACT

The apparatus includes a flame extinguishing member having an opening extending therethrough for freely receiving the wick of a candle and a stop for stopping downward movement of the member at a selected level for extinguishing the flame as it burns below the top of the member. In one embodiment, the stop is inserted into the candle from its side to a position next to the wick to stop downward movement of the flame extinguishing member as the member engages the stop. In another embodiment, an elongated guide is supported near the candle along its length and a sliding member is provided to slide along the length of the guide until it engages a stop coupled to the elongated guide. The fire extinguishing member and the sliding member are coupled together such that the sliding member moves downward with the fire extinguishing member until it engages the stop located at a selected level which stops downward movement of the fire extinguishing member.

14 Claims, 4 Drawing Sheets

CANDLE EXTINGUISHING APPARATUS

BACKGROUND OF THE INVENTION

1. Field of the Invention

The invention relates to a device for automatically extinguishing the flame of a candle.

2. Description of the Prior Art

Candles typically burn until fully consumed or manually extinguished by a person. If they are forgotten they will fully consume themselves and this may be contrary to the intent of the person who lit them. Further, if a candle is lit and forgotten, it may be left burning unattended in a house or building. It is desirable that the amount of the candle that will burn be able to be predetermined so as to avoid the above mentioned waste and prolonged hazard. Multiple snuffing devices have been invented for extinguishing the candle in the event that it tips or turns over. U.S. Pat. No. 5,944,505 discloses a candleholder which automatically extinguishes the candle by moving said candle on a pivot arm. A device for automatically extinguishing a candle which is less cumbersome and does not require movement of the candle is needed.

SUMMARY OF THE INVENTION

It is an object of the invention to provide a new and useful apparatus for automatically extinguishing the flame of a candle when the candle burns down to a selected level.

The apparatus comprises a flame extinguishing member having an opening extending therethrough for freely receiving the wick of a candle and a stop for stopping downward movement of the member at a selected level for extinguishing the flame as it burns below the top of the member.

In one embodiment, the stop is inserted into the candle from its side to a position near the wick to stop downward movement of the flame extinguishing member as the member engages the stop.

In another embodiment, an elongated guide is supported near the candle along its length and a sliding member is provided to slide along the length of the guide until it engages a stop coupled to the elongated guide. The fire extinguishing member and the sliding member are coupled together such that the sliding member moves downward with the fire extinguishing member until it engages the stop located at a selected level which stops downward movement of the fire extinguishing member.

DESCRIPTION OF THE PREFERRED EMBODIMENTS

Figure 5A:
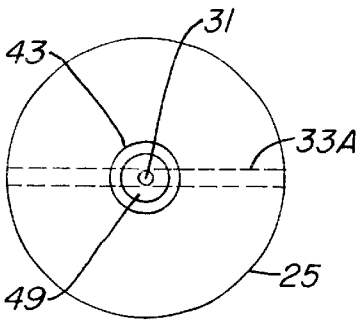
FIG. 5A is a top view of FIG. 5.
Figure 2:
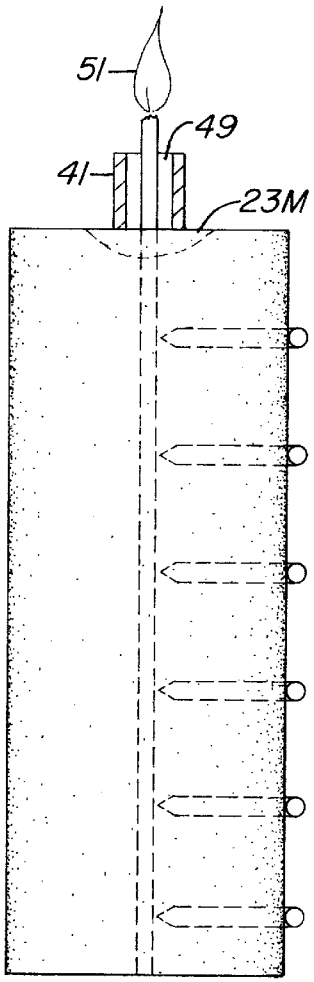
FIG. 2 is a side view of the apparatus of FIG. 1 in an assembled condition.
Figure 1:
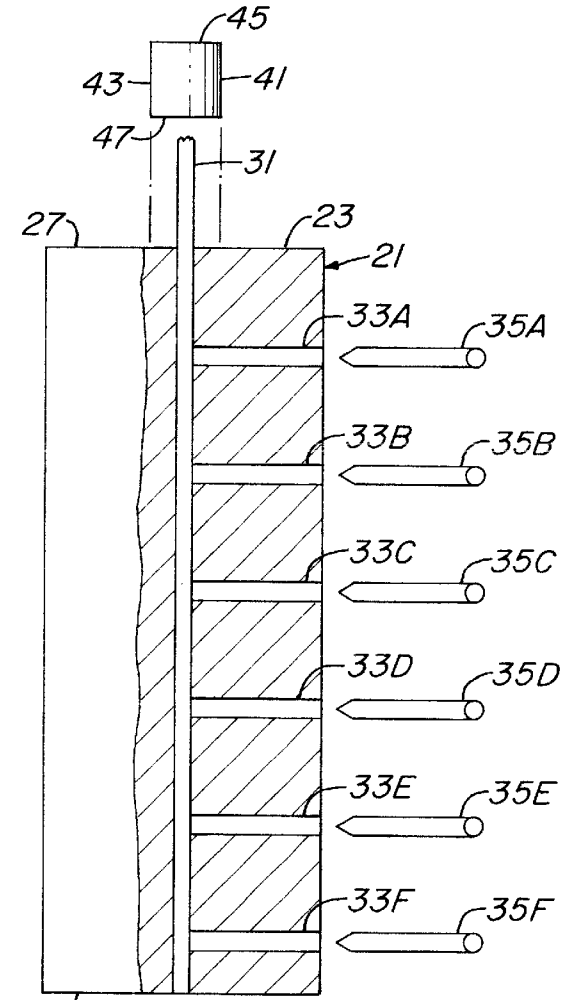
FIG. 1 is a partial cross-sectional and exploded view of one embodiment of the apparatus of the invention.
Figure 4:
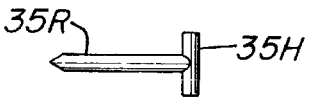
FIG. 4 illustrates one of the stops of FIGS. 1–3.

Referring now to FIGS. 1 and 2, there is illustrated a candle 21, comprising a body 23 having a cylindrical side wall 25, a top end 27, a bottom end 29, and a wick 31 extending through the body along its axis from the bottom end 29 to the top end 27 and extending upward beyond the top end. The body 23 may be formed of wax, paraffin, or other suitable material and the wick 31 may be formed of cotton or other suitable material impregnated with wax or paraffin. A plurality of cylindrical apertures 33A, 33B, 33C, 33D, 33E, 33F extend radially into the body 23 to the wick 31 for receiving stops 35A, 35B, 35C, 35D, 35E, 35F. Referring to FIG. 4, each stop comprises a cylindrical rod 35R with a handle 35H attached to an end thereof. The stops may be formed of a suitable metal such as iron or steel.

Also provided is annular fire extinguishing member 41 having a cylindrical side wall 43 with two opposite end 45 and 47 and an opening 49 extending therethrough. The opening 49 has a diameter large enough to freely receive the wick 31. The member 41 may be formed of iron or steel.

Figure 6:
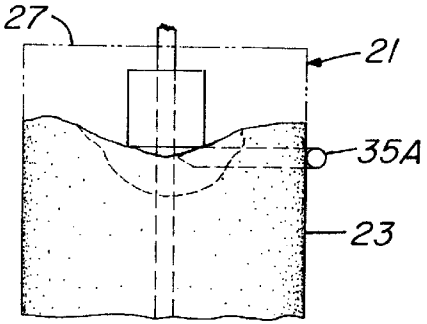
FIG. 6 is a partial side view of the apparatus of FIGS. 1, 2 and 3 with the fire extinguishing member engaging a stop.

In burning the candle, the wick 31 is lit to form a flame 51 as shown in FIG. 2. As the wick burns, the melted wax, paraffin of the candle is drawn up to the wick to be burned. The melted wax is shown at 23M in FIG. 2. The member 41 becomes hot and descends into the melted wax down the wick. As the wick and wax continue to burn down as shown in FIG. 6, the member 41 will engage the stop 35A as shown in FIG. 6 which will prevent further downward movement of the member 41. As the wick 31 and wax continue to burn, the wick will burn into the member 41 below the upper end 45 of the member 41 at which point the flame Will be extinguished due to the lack of oxygen. Thus the stop 35A and member 41 automatically extinguish the flame of the candle at the level dependent on a level of the stop 35A. If the user desires to allow the candle to burn to a lower level the stop 35A may be removed to allow the stop 35B to control the level of burning, etc.

Figure 3:
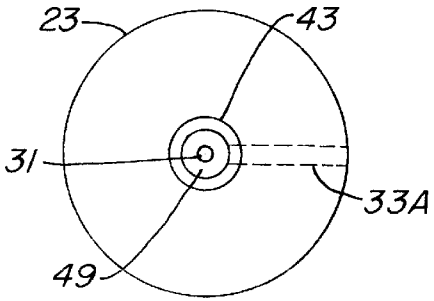
FIG. 3 is a top view of FIG. 2.
Figure 5:
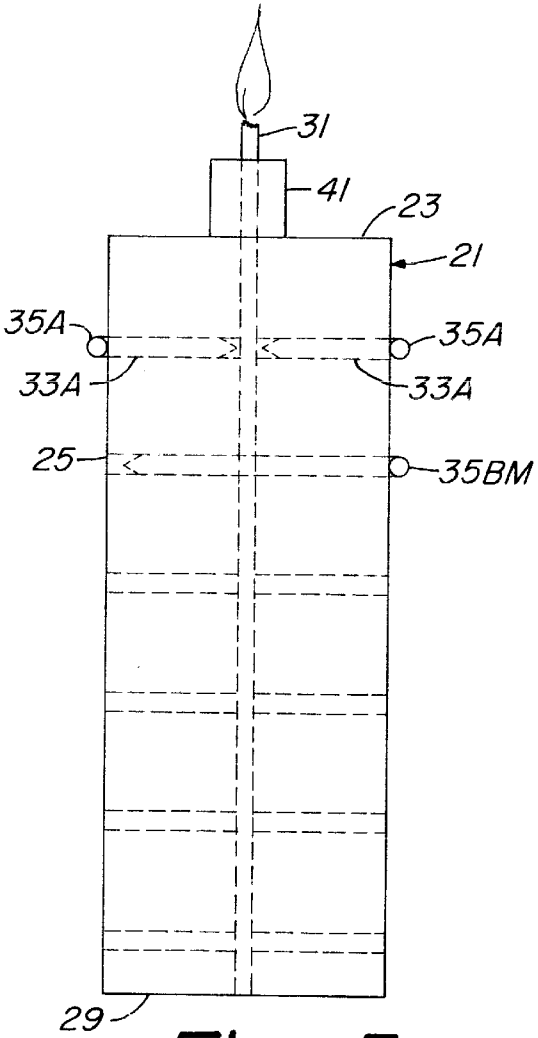
FIG. 5 is a modification of the apparatus of FIGS. 1 and 2.

In the embodiment of FIG. 5, the candle body 23 is similar to that of FIGS. 1–3 but the apertures 33A, 33B, 33C, 33D, 33E, and 33F extend completely through the candle and its axis. Two sets of stops 35A, 35B, 35C, 35D, 35E and 35F may extend to the wick from each end or side of the apertures 33A, 33B, 33C, 33D, 33E, and 33F respectively as illustrated by stops 35A or each of the stops 35A, 35B, 35C, 35E, and 35F may be long enough to penetrate the wick 31 as illustrated by stop 35BM. In addition, instead of having stops in each aperture, a single stop i.e. stop 35A may be located in either of the apertures 33A, 33B, 33C, 33D, 33E, 33F depending on the level the user wants the candle to burn down to.

Figure 8:
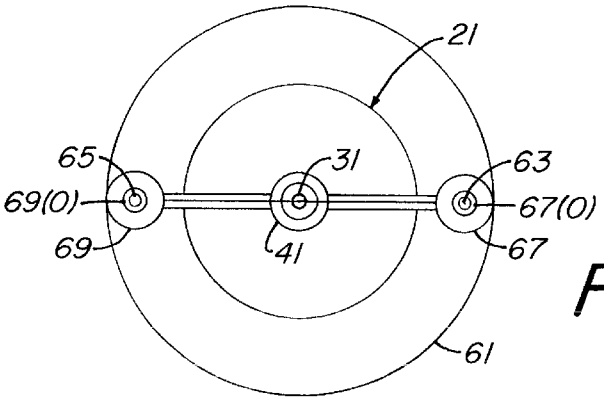
FIG. 8 is a top view of the apparatus of FIG. 7.
Figure 7:
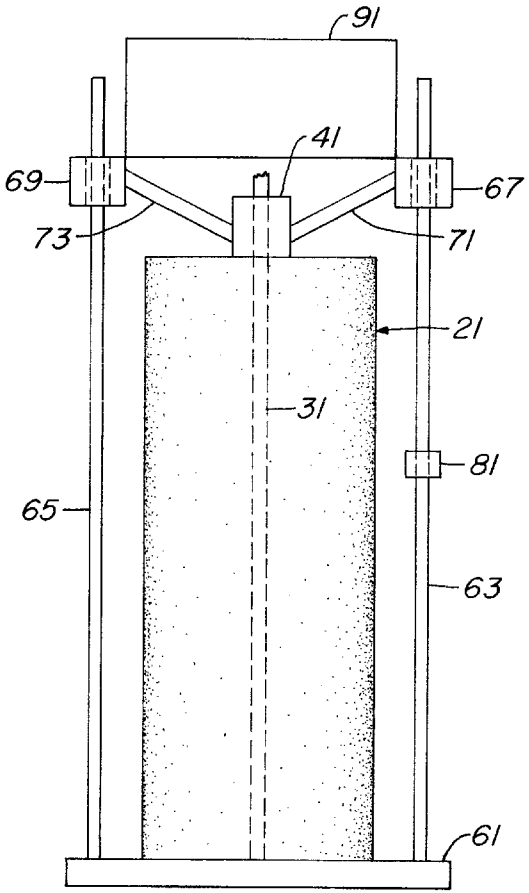
FIG. 7 illustrates another embodiment of the invention.

Referring now to FIG. 7, the candle 21 is the same as the candle of FIG. 1 and 23 but does not have the radially extending apertures 33A, 33B, 33C, 33D, 33E, 33F. The candle 21 is mounted on a stand or base 61. Secured to the base 61 spaced from and on opposite sides of the candle 21 are two elongated metal guides 63 and 65. Two metal tubular members 67 and 69 are slidably located around the guides 63 and 65 respectively. In this respect the openings 67(O) and 69(O) freely receiver the guides as shown in FIG. 8.

Sliding member 67 is fixedly secured to one side of the member 41 by a metal rod 71 and sliding member 69 is fixedly secured to the opposite side of the member 41 by a rod 73. Attached to guide 63 is a stop 81 which can be moved to different levels on the guide. The stop 81 may be a spring biased clip or other type of member which can be removably secured to the guide 63 at different levels. As the candle burns down, the member 41 descends and hence the tubes 67 and 69 descend on the guides 63 and 65 until the tube 67 reaches stop 81 where the tube 67 is stopped which in turn causes tubular member 69 and member 41 to stop. At this level of the member 41, the wick burns down until it is below the level of the upper end 45 of member and the flame is extinguished.

Attached to the tubular member 67 and 69 and connecting members 71 and 73 is a decorative wind shield 91 which may be of suitable metal such as iron or steel. As the members 41, 167, 69, 71, 73 descend, the wind shield 91 descends. The wind shield 91 may be curved to the one side of the flame.

Figure 9:
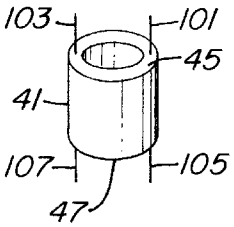
FIG. 9 illustrates a modification of the flame extinguishing member.
Figure 10:
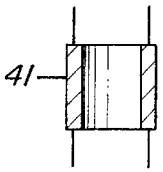
FIG. 10 is a cross-section of the member of FIG. 9.

Referring to FIGS. 9 and 10, the metal flame extinguishing member 41 has two metal arms 101 an 103 connected thereto and extending above the end 45 and two metal legs 105 and 107 connected thereto and extending below the end 47. Preferably the arms 101 and 103 are 180° apart; legs 105 and 107 are 180° apart; arm 101 and leg 105 are aligned; and arm 103 and leg 107 are aligned. The arms 101 and 103 help transfer more heat from the flame to the member 41 and to the legs 105 and 107. The legs help burn more wax in the member 41 and below the member 41 after the member has been stopped by the stop leaving a longer length of wick 31 exposed after the flame is extinguished. This allows the candle to be more easily re-ignited at a later time.

Figure 14:
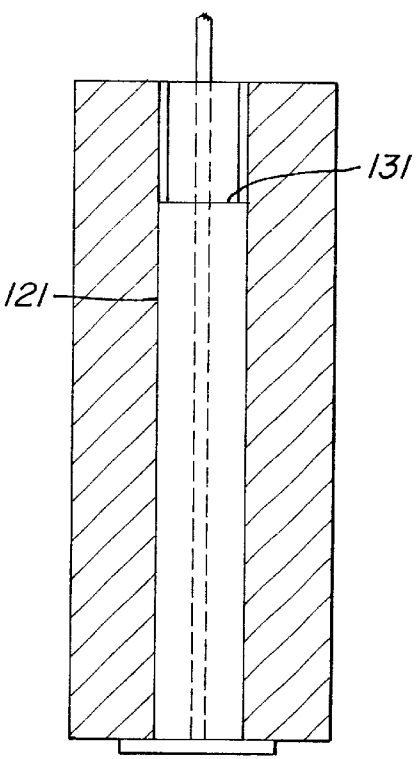
FIGS. 11–14 illustrate another embodiment of the invention.
Figure 13:
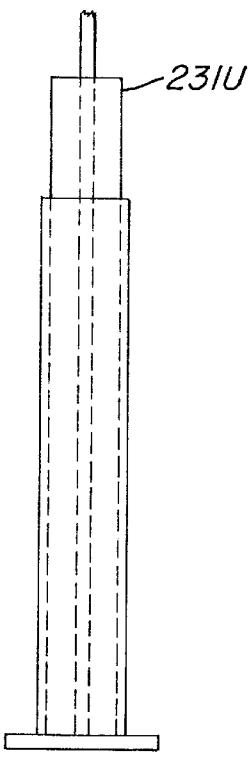
Figure 12:
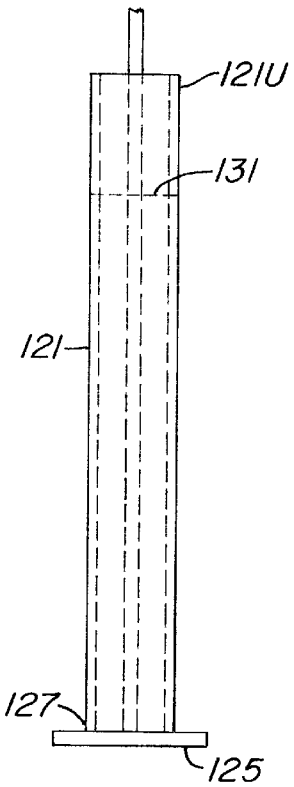
Figure 11:
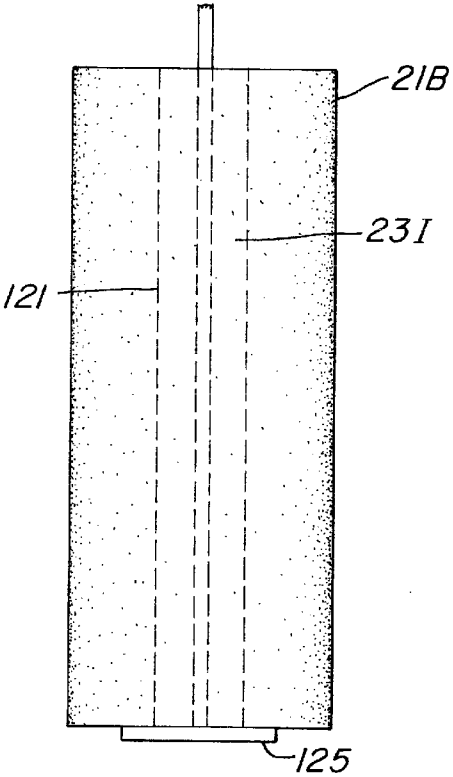

Referring to FIG. 11, the candle 21 B has a removable tubular metal member 121 extending through the body 23 surrounding the wick 31 and an interior portion 23(I) of wax. A base 125 is connected to the lower end 127 of the tubular member 121. The tubular member 121 may be removed from the body 23 as shown in FIG. 12 and severed at a selected level such as at 131. The severed upper portion 121U may be removed exposing the candle portion 23(IU). The tubular member 121 then is inserted back into the candle as shown in FIG. 14. As the wick and candle burn down, the wick will burn down until the wick extends below the top level 131 of the member 121 where the flame will be extinguished due to the lack of oxygen.

What is claimed is:

1. An apparatus comprising:

a candle comprising a body having a length, an outer side, an upper end, a lower end, and a wick located in said body along its said length and extending out of said upper end to be ignited to create a flame, a flame extinguishing member comprising first and second opposite ends with an opening extending therethrough between said first and second opposite ends, said opening having a size sufficient to receive said wick with said second end located below said first end and to allow said member to move along said wick as said wick is burned and said body below the flame is melted and burned, and a stop adapted to be located at a given level between said upper and lower ends of said body to stop movement of said member as said member reaches a selected level to extinguish the flame of said wick and candle as said wick burns below said first end of said member, said stop extends into said body from said outer side to a position near said wick for engaging said second end of said member as said second end of said member reaches said stop.

2. The apparatus of claim 1, wherein:

said member is formed of metal.

3. The apparatus of claim 2, comprising:

at least one metal arm coupled to said upper end of said member and extending upward and at least one metal leg coupled to said lower end of said member and extending downward.

4. An apparatus, comprising:

a candle comprising a body having a length, an outer side, an upper end, a lower end, and a wick located in said body along its said length and extending out of said upper end to be ignited to creates a flame, at least one aperture extending into said body from said outer side to a position near said wick between said upper end and said lower end, a stop having a size sufficient to allow said stop to be inserted into said aperture to a position near said wick, and a flame extinguishing member having first and second opposite ends with an opening extending therethrough between said first and second opposite ends, said opening having a size sufficient to receive said wick and to allow said member to move along said wick as: said wick is burned and said body below the flame is melted,d and burned until said second end of said member engages said stop to extinguish the flame of said wick and candle as said wick burns below said first end of said member.

5. The apparatus of claim 4, comprising:

a plurality of spaced apart apertures extending into said body from said outer side to a position near said wick between said upper end, and said lower end, each of which is adapted to receive said stop.

6. The apparatus of claim 4, wherein:

said member is tubular in shape.

7. The apparatus of claim 6, wherein:

said member is formed of metal.

8. The apparatus of claim 5, wherein:

said member is tubular in shape.

9. The apparatus of claim 8, wherein:

said member is formed of metal.

10. The apparatus of claim 7, comprising:

a plurality of spaced apart removable stops extending into said body from said outer side to a position near said wick between said upper and lower ends.

11. The apparatus of claim 10, wherein:

said stops are removable from said body.

12. An apparatus, comprising:

a candle comprising a body having a length, an outer side, an upper end, a lower end, and a wick located in said body along its said length and extending out of said upper end to be ignited to create a flame, at least one stop extending into said body from said outer side to a position near said wick between said upper and lower ends, and a flame extinguishing member having first and second opposite ends with an opening extending therethrough between said first and second opposite ends, said opening having a size sufficient to receive said wick and to allow said member to move along said wick as said wick is burned and said body below the flame is melted and burned until said second end of said member engages said stop to extinguish the flame of said wick and candle as said wick burns below said first end of said member.

13. The apparatus of claim 12, wherein:

said member is tubular in shape.

14. The apparatus of claim 13, wherein:

said member is formed of metal.

* * * * *